US006563257B2

(12) United States Patent
Vojak et al.

(10) Patent No.: US 6,563,257 B2
(45) Date of Patent: May 13, 2003

(54) MULTILAYER CERAMIC MICRODISCHARGE DEVICE

(75) Inventors: Bruce A. Vojak, Mahomet, IL (US); J. Gary Eden, Mahomet, IL (US); Sung-Jin Park, Sung-Nam (KR); Clark Wagner, Urbana, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 306 days.

(21) Appl. No.: 09/753,242

(22) Filed: Dec. 29, 2000

(65) Prior Publication Data

US 2002/0113553 A1 Aug. 22, 2002

(51) Int. Cl.[7] ..... H01J 19/00

(52) U.S. Cl. ..... 313/356; 313/618; 313/631; 313/495

(58) Field of Search ..... 313/356, 493, 313/631, 491, 496, 618, 574, 311, 326, 582, 585, 586, 355, 495, 309, 310, 351; 445/24, 25, 50

(56) References Cited

U.S. PATENT DOCUMENTS

| | | | | |
|---|---|---|---|---|
| 3,487,254 A | | 12/1969 | Vollmer | 313/218 |
| 3,697,797 A | | 10/1972 | Feyheit et al. | 313/217 |
| 3,908,147 A | | 9/1975 | Hall et al. | 313/210 |
| 3,970,887 A | | 7/1976 | Smith et al. | 313/309 |
| 4,060,748 A | | 11/1977 | Bayless | 313/171 |
| 4,459,636 A | | 7/1984 | Meister et al. | 361/321 |
| 4,698,546 A | | 10/1987 | Maitland et al. | 313/446 |
| 4,808,883 A | | 2/1989 | Iwaya et al. | 313/632 |
| 4,890,031 A | | 12/1989 | Zweir | 313/409 |
| 4,988,918 A | | 1/1991 | Mori et al. | 313/641 |
| 5,438,343 A | | 8/1995 | Khan et al. | 313/493 |
| 5,496,199 A | | 3/1996 | Makishima et al. | 445/4 |
| 5,514,847 A | | 5/1996 | Makishima et al. | 219/121.12 |
| 5,926,496 A | | 7/1999 | Ho et al. | 372/92 |
| 5,990,620 A | | 11/1999 | Lepselter | 313/585 |
| 6,016,027 A | | 1/2000 | DeTemple et al. | 313/356 |
| 6,139,384 A | * | 10/2000 | DeTemple et al. | 445/24 |
| 6,194,833 B1 | | 2/2001 | DeTemple et al. | 313/631 |

FOREIGN PATENT DOCUMENTS

| | | |
|---|---|---|
| JP | 63-174239 | 7/1988 |

OTHER PUBLICATIONS

A. El–Habachi, W. shl, M. Moselhy, R. H. Stark and K. HJ. Schoenbach, "Series Operation of Direct Current Xenon Chloride Excimer Sources," *Journal of applied Physics*, vol. 88, No. 6, Sep. 15, 2000, pp. 3220–3224.

A. D. White, "New Hollow Cathode Glow Discharge," *Journal of Applied Physics*, vol. 30, No. 5, May, 1959, pp. 711–719.

(List continued on next page.)

*Primary Examiner*—Robert H. Kim
*Assistant Examiner*—Elizabeth Gemmell
(74) *Attorney, Agent, or Firm*—Greer, Burns & Crain, Ltd.

(57) ABSTRACT

A discharge device of the invention includes multiple bonded ceramic layers with electrodes formed between the layers. It can be combined with the various MCIC technologies to produce myriad useful devices. Contacts are made to the electrodes, which may be grouped in different arrangements. The electrodes contact a hole through some or all of the ceramic layers to define a discharge cavity. Different groupings of the electrodes will produce different types of discharge. Alternating the electrodes in interdigitated pairs permits an arbitrary extension of the discharge cavity length. Having consecutive anodes or cathodes permits formation of regions where electrons may cool. Another device of the invention includes a multilayer ceramic structure having a hole formed in a least one outer layer through an electrode on the outer side of the layer and in contact with an electrode between two layers. A contact is formed to the electrode between layers through any remaining layers in the multilayer ceramic structure.

17 Claims, 6 Drawing Sheets

OTHER PUBLICATIONS

R. H. Schoenbach, R. Verhappen, T. Tessnow , F. E. Peterkin and W. W. Byszewski, "Microhollow Cathode Discharges," *Appl. Phys. Lett.*, vol. 68, No. 1, Jan. 1996, pp. 13–15.

L. D. Biborosch, O. Bilwatsch, S. Ish–Shalom, E. Dewald, U. Ernst and K. Frank, "Microdischarges With Plane Cathodes," *Appl. Phys. Lett.*, vol. 75, No. 25, Dec. 20, 1999, pp. 3926–3928.

S.J. Park, C.J. Wagner, C.M. Herring, and J.G. Eden, "Flexible microdischarge arrays: Metal/polymer devices", Applied Physics Letters, vol. 77, No. 2, Jul. 10, 2000, pp. 199–201.

J.W. Frame, D.J. Wheeler, T.A. DeTemple, and J.G. Eden, "Microdischarge devices fabricated in silicon", Applied Physics Letters, vol. 71, No. 9, Sep. 1, 1997, pp. 1165–1167.

J.W. Frame, P.C. John, T.A. DeTemple, and J.G. Eden, "Continuous–wave emission in the ultraviolet from diatomic excimers in a microdischarge", Applied Physics Letters, vol. 72, No. 21, May 23, 1998, pp. 2634–2636.

J.W. Frame, and J.G. Eden, "Planar microdischarge arrays", Electronics Letters, vol. 34, No. 15, Jul. 23, 1998, pp. 1529–1531.

* cited by examiner

MULTILAYER CERAMIC MICRODISCHARGE DEVICE

STATEMENT OF GOVERNMENT INTEREST

This invention was made with Government assistance under U.S. Air Force Office of Scientific Research grant nos. F49620-98-1-0030, F49620-99-1-0106, and F49620-99-1-0317. The Government has certain rights in this invention.

FIELD OF THE INVENTION

The field of the invention is microdischarge devices and arrays. The invention is applicable to multilayer ceramic integrated circuit devices and hybrid packaged silicon integrated circuits.

BACKGROUND OF THE INVENTION

Microdischarge devices excite a small volume of discharge in a gas or vapor through electrodes to produce, for example, a display, a chemical sensor, or a device to dissociate toxic or hazardous gases. Microdischarges have the potential to be superior to many types of other light display technologies, such as liquid crystal displays and cathode ray tubes. However, several potential applications of microdischarges require devices that are rugged, capable of operation at elevated temperatures and yet be integrated with electronic components.

There continues to be a need for improved microdischarge devices having suitable brightness characteristics and which are able to be integrated into existing and emerging integrated circuit technologies, and thick film processes, in particular.

SUMMARY OF THE INVENTION

The invention meets this need for an improved device. The invention is a novel type of microdischarge device that may be integrated into multilayer ceramic integrated circuit (MCIC) technology. MCIC technology can serve as a substrate for silicon integrated circuits, Group III-V integrated circuits, as well as discrete components. In addition, devices such as inductors and capacitors can be formed in MCIC devices.

A discharge device of the invention includes multiple bonded ceramic layers with electrodes formed between the layers. It can be combined with the various MCIC technologies to produce myriad useful devices. Contacts are made to the electrodes, which may be grouped in different arrangements. The electrodes contact a hole through some or all of the ceramic layers that define a discharge cavity. Different groupings of the electrodes will produce different types of discharge and serve different applications. Alternating the electrodes in interdigitated pairs permits an arbitrary extension of the discharge cavity length. Having consecutive anodes or cathodes permits formation of regions where electrons may cool. Another device of the invention includes a multilayer ceramic structure having a hole formed in a least one outer layer through an electrode and in contact with another electrode.

DETAILED DESCRIPTION OF THE INVENTION

In referring to the microdischarges in the figures, the terms "horizontal" and "vertical" are used as a matter of convenience to help identify figure elements. Artisans will appreciate that orientation of the microdischarges, in practice, is generally unimportant and that the terms "horizontal" and "vertical" accordingly do not limit elements of the preferred embodiments to the convenient orientations shown in the figures.

Figure 1A:
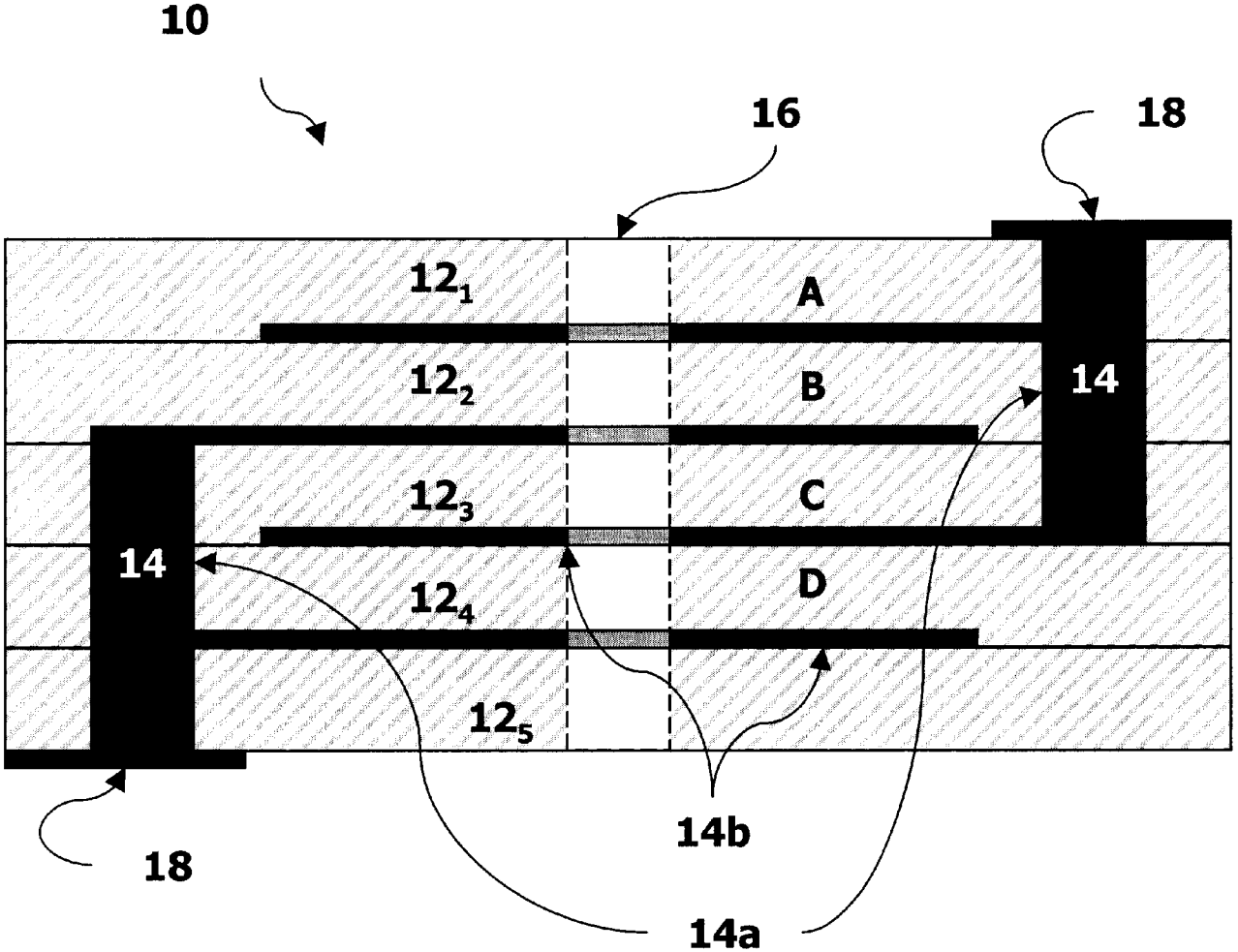
FIG. 1A is a schematic diagram of a multilayer discharge structure with interdigitated electrodes according to the invention.

Referring now to FIG. 1A, a preferred embodiment microdischarge 10 according to the invention is schematically represented. The discharge 10 includes a plurality of bonded ceramic layers $\mathbf{12}_N$. Two sets (A and C, B and D) of interdigitated electrodes 14, are in contact with a cavity 16 formed by a through hole which penetrates all of the bonded ceramic layers $\mathbf{12}_1$–$\mathbf{12}_N$. The cavity 16 becomes filled with a discharge gas or vapor when the discharge is incorporated into an operational device. Exposed contacts 18 allow powering of the electrodes to excite discharge of a gas or vapor contained in the cavity. Though contacts 18 are shown on an outer surface of a layer in FIG. 1A and other figures, the illustration is merely an example. Location of the contacts on the outer surface of an uppermost ceramic layer $\mathbf{12}_1$ and/or a lowermost ceramic layer $\mathbf{12}_N$ is convenient because the metal used to connect the contacts 18 to portions of the electrodes 14 may be easily formed in via holes within each ceramic layer. However, when a microdischarge of the invention is integrated with other devices, it may be advantageous or desirable to form "buried" contacts that are contacted through other layers. In the integrated device case, the contact may be part of a circuit interconnection metal pattern. Thus, "contact", as used herein, encompasses discrete contacts as well as contacts that form part of circuit interconnections. From the illustrated surface contacts 18, metal is introduced into an opening through the of ceramic layers to form vertical electrode portions 14*a* in FIG. 1, and along an inner surface of the ceramic layers to form horizontal electrode portions 14*b* that extend to contact the cavity 16. The horizontal electrode portions 14*b* preferably surround an entire circumference of the cavity 16 (if it is a circular cavity), i.e., the cavity 16 penetrates the electrode portions 14*b* in the same manner as it penetrates the layers $\mathbf{12}_1$–$\mathbf{12}_N$.

The ceramic layers $\mathbf{12}_1$–$\mathbf{12}_N$ withstand high temperature operation and permit formation of the microdischarge in a multilayer ceramic integrated circuit (MCIC) structure. Conventional ceramic multilayer formation techniques may be used to from the microdischarge 10 with the electrodes 14. The cavity is most easily formed when the ceramic layers are in the "green" state, by punching, drilling, or other conventional ceramic processing techniques. Once fabricated, the device is then "fired" in an oven, resulting in a rugged, monolithic ceramic structure.

The interdigitation of electrodes 14 shown in the FIG. 1 preferred embodiment allows arbitrary extension of the cavity 16 in its axial direction. This extension is limited only by the ability to continue to stack ceramic layers. However, alternate electrode pairings may be used to produce a different type of device. As an example, the arrangement of cathodes and anodes, can be altered to produce unexcited regions in which energetic electrons can cool. Such a preferred device is shown in FIG. 1B, including a set of consecutive anodes 14AN, disposed between cathodes 14CT. The pair of anodes 14AN separate the cathodes 14CT from each other. A region of the cavity 16 between the cathodes 14CT is a region in which electrons can cool. To create a predetermined cooling region, the layer $\mathbf{12}_3$ has a thickness t2. The thickness of t2 may be chosen based upon the desired degree of electron cooling if the MCIC structure were to be used as a laser. In certain classes of lasers, such as the recombination lasers, output power and efficiency are improved by providing a region for electrons to cool. The structure of FIG. 1B could be used as a laser with mirrors situated at either end of the cavity 16 and properly aligned, assuming the gas or vapor is suitable as a laser (pulsed or continuous) medium.

It should also be noted that the anode and cathode designations discussed with respect to the preferred embodiments are not meaningful where the devices are to be driven with AC voltage applied to electrodes. However, a layer of thickness t2, which may exceed some or all of the other layers having an exemplary thickness t1, serves to cool the discharge electrons in the case of different polarity DC voltages being applied to electrodes or in the case of the electrodes being driven by the same AC voltage. In sum, uniform layer thickness produce electrode spacings that are uniform, while layers having different thicknesses will produce electrodes with different spacings.

Figure 1B:
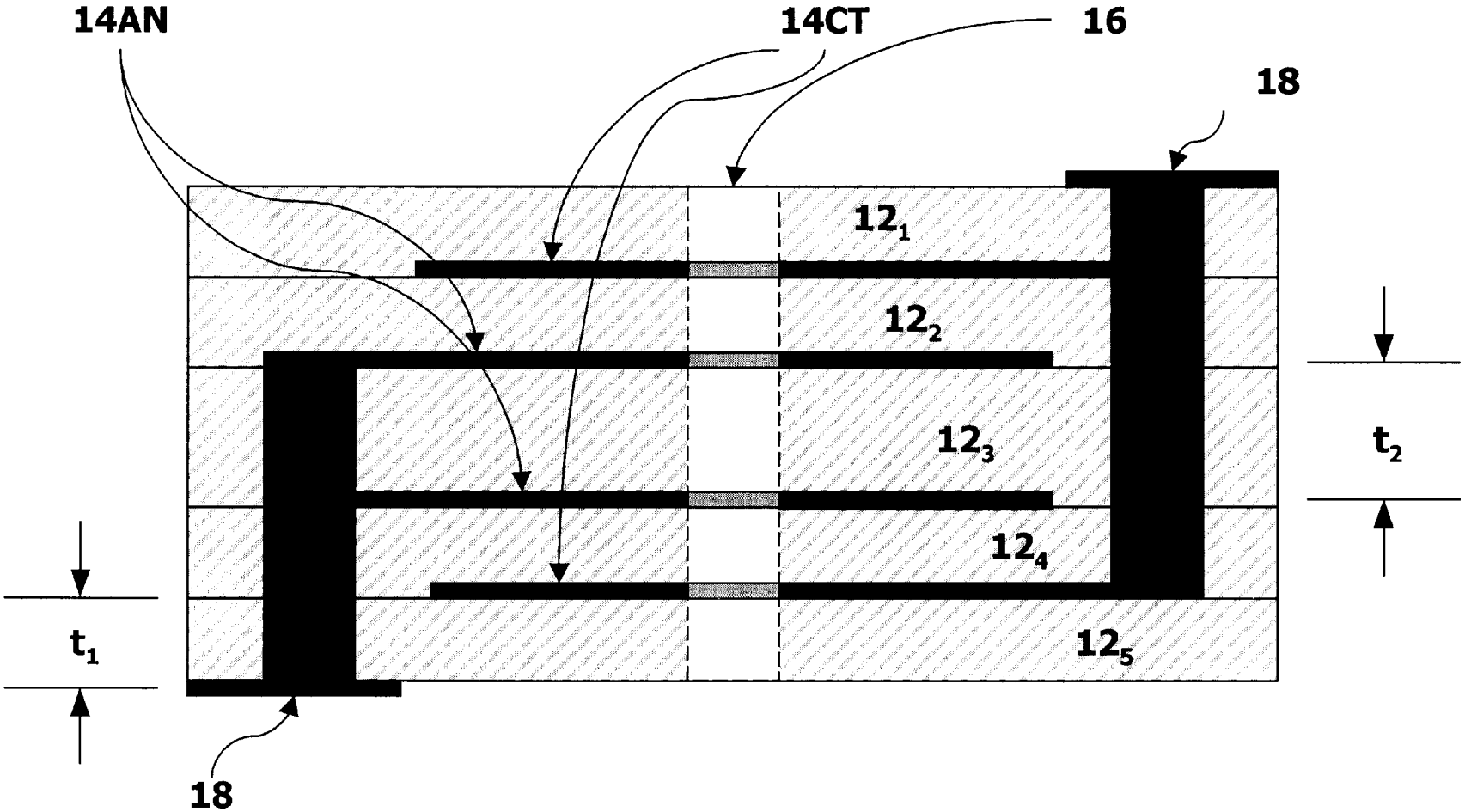
FIG. 1B is a schematic diagram of a multilayer discharge structure with noninterdigiated electrodes to form an electron-cooling region.
Figure 2:
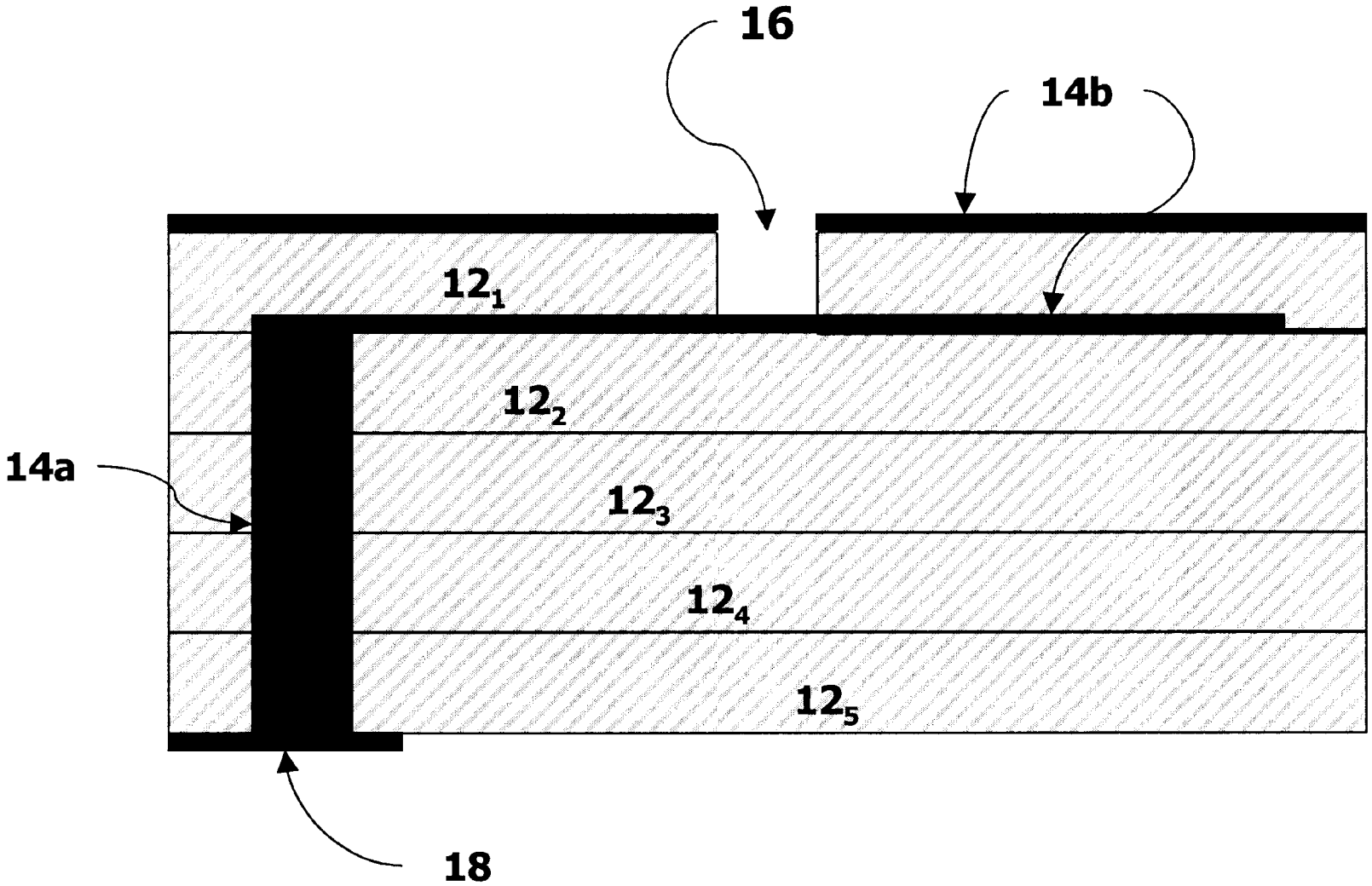
FIG. 2 is a schematic diagram of a multilayer discharge structure according to the invention.

The preferred microdischarges of FIGS. 1A and 1B include the cavity 16 as a through hole that would be useful to realize a laser or, for example, in applications such as gas chromatography. An alternate microdischarge 10*a* is shown in FIG. 2. In FIG. 2, the cavity 16 exposes a horizontal electrode portion 14*b* formed between layers $\mathbf{12}_1$ and $\mathbf{12}_2$. Another horizontal electrode portion 14*b* is formed on the surface of layer $\mathbf{12}_1$ and is penetrated by the cavity 16. Since it is exposed, it may be contacted directly, while a contact 18 and vertical electrode portion 14*a* make contact to the horizontal electrode portion 14*b* exposed at the bottom of the cavity 16.

Figure 1C:
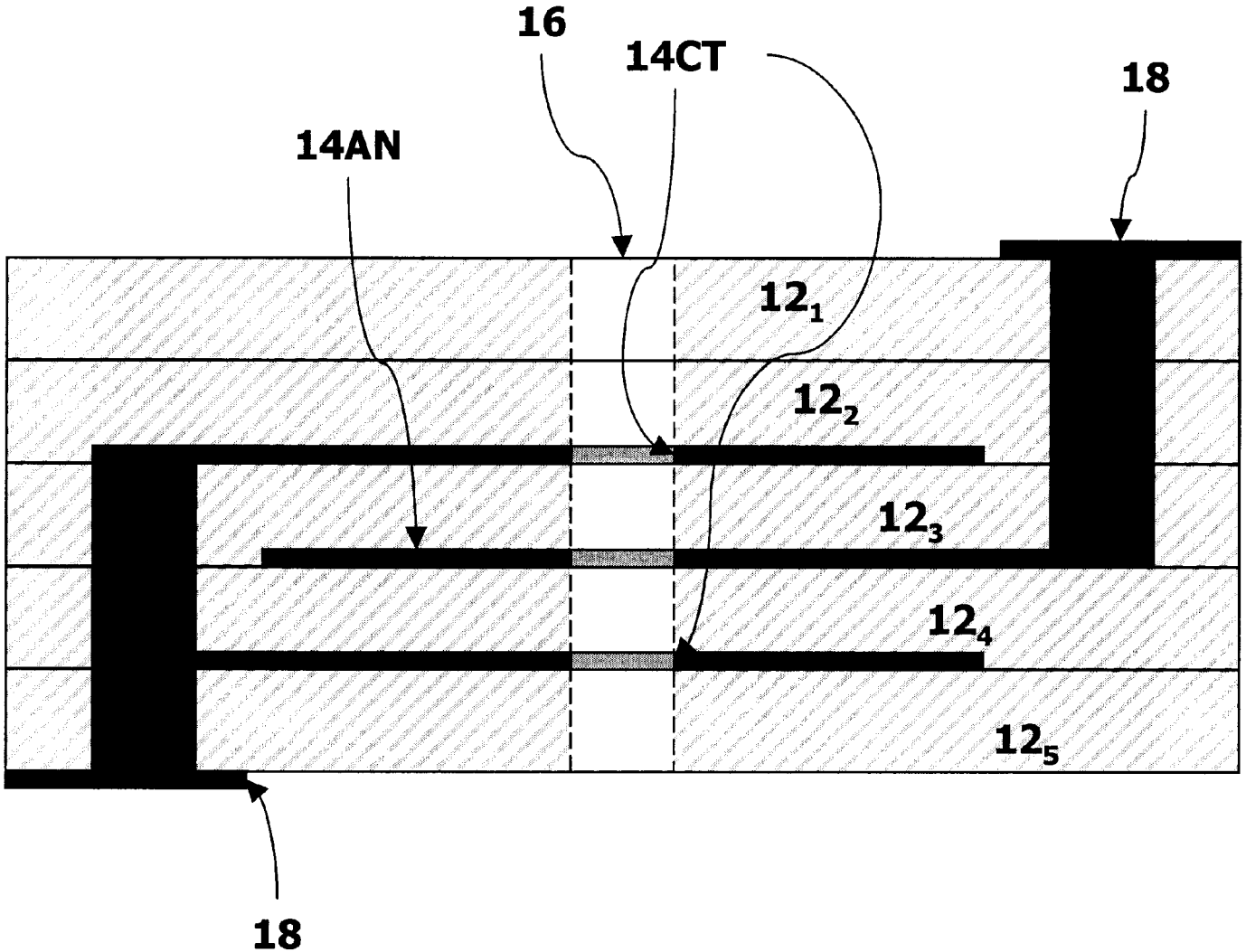
FIG. 1C is a schematic diagram of a multilayer discharge structure including an odd number of electrodes.
Figure 1D:
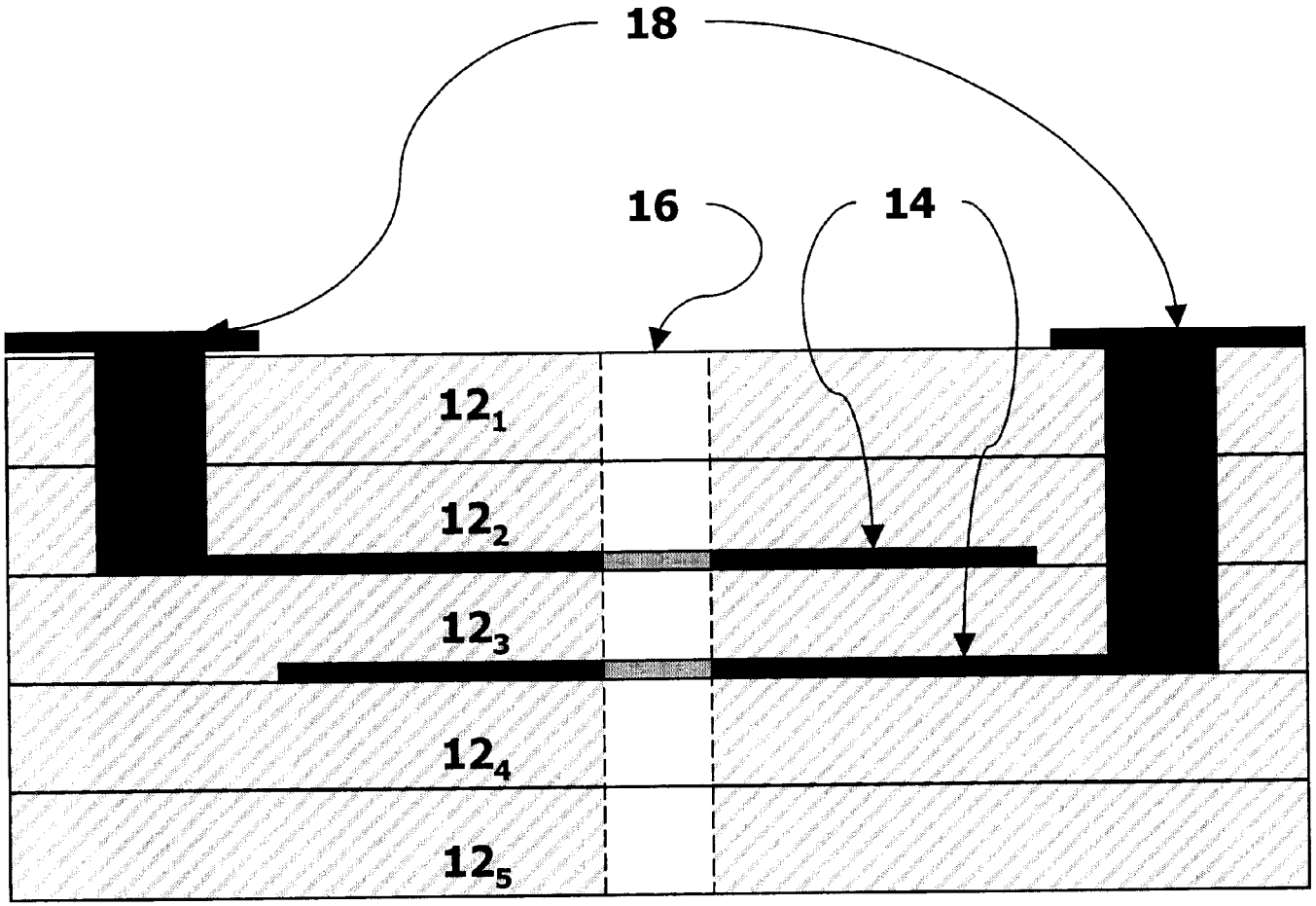
FIG. 1D is a schematic diagram of a multilayer discharge structure including contacts formed on a common surface.

The preferred microdischarges of FIGS. 1A and 1B also illustrate an even number of electrodes 14 with contacts 18 on opposite sides of the device. As indicated by the differences between FIGS. 1A and 1B, the number and arrangement of electrodes may be modified to suit different applications. The present limits of MCIC fabrication processes are the essential limits on the number and arrangement of electrodes and contacts. As additional example structures, FIG. 1C illustrates a microdischarge structure with an odd number of electrodes (two cathodes 14CT and one anode 14AN), and FIG. 1D illustrates a microdischarge with contacts 18 for two electrodes 14 formed on a common side of the structure.

Figure 3:
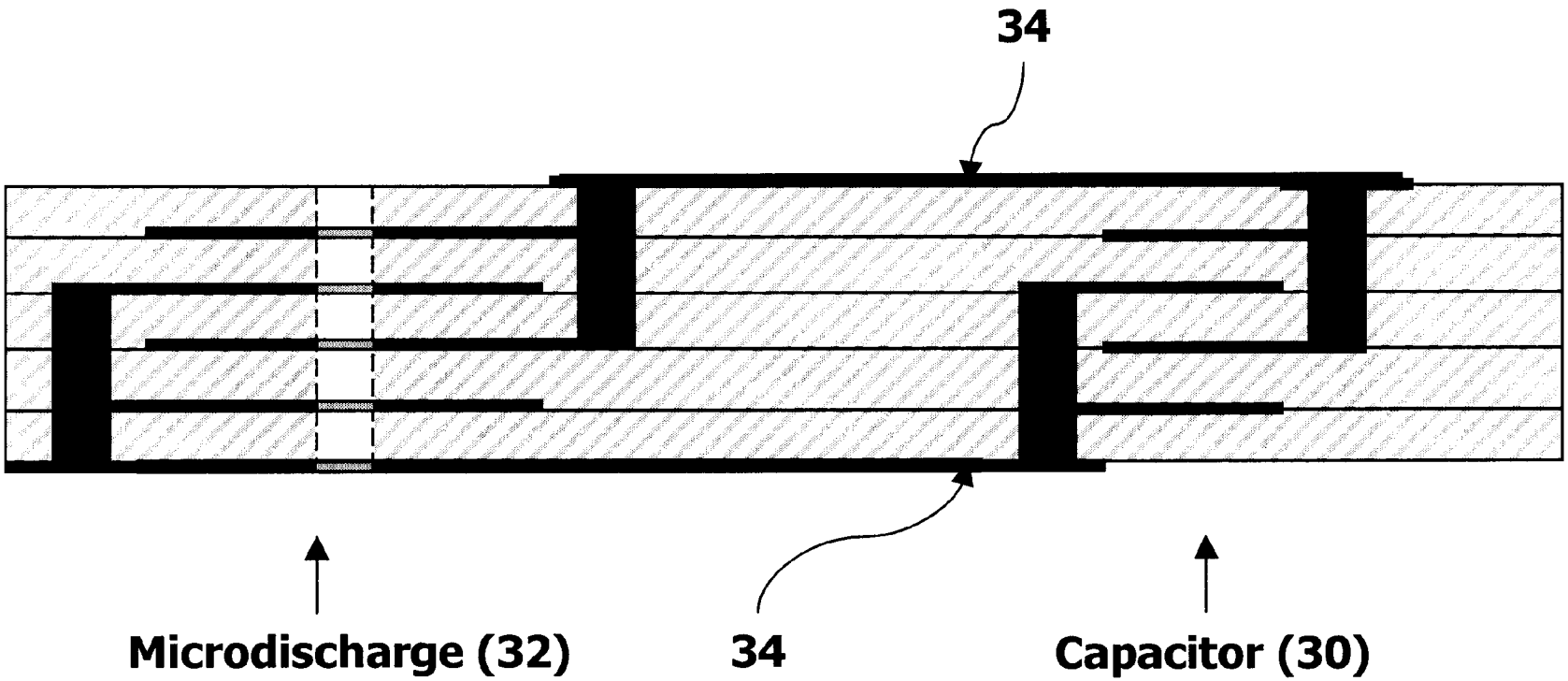
FIG. 3 is a schematic diagram of a MCIC including a microdischarge and capacitor.

A ceramic multilayer discharge of the invention may be integrated into MCIC structures with other MCIC devices. As an example, FIG. 3 illustrates a device including a shunt capacitor 30 and interdigitated microdischarge 32. Typically, the capacitor 30 will have a larger area relative to the microdischarge 32. Common electrodes 34 are used to connect to both devices. Artisans will appreciate that a microdischarge of the invention may be integrated with other MCIC devices to form many types of useful integrated devices. One of the many applications of the structure of FIG. 3 is that the capacitor, when the microdischarge 32 is operated as a laser, can serve as an energy storage or "peaking" capacitor.

A prototype device of the FIG. 1A embodiment has been fabricated and tested. Rare gases have been used in prototypes made thus far, but any suitable gas, vapor, or gas or vapor laser active medium could be used. The experimental device produced a bright and uniform discharge.

Specifically, a three-stage, multi-layer ceramic microdischarge prototype device, having an active length of ~267 $\mu$m and a cylindrical discharge channel 140–150 $\mu$m in diameter, has been operated continuously in Ne gas. Stable glow discharges are produced for pressures above 1 atm, operating voltages as low as 137 V (at 800 Torr) and specific power loadings of ~40 kW-cm$^3$. The V-I characteristics for a fired ceramic structure exhibit a negative resistance whereas the resistance is positive prior to firing. The manufacturability of the fabrication process as well as the "flow through" and multi-stage design of this device make it well suited for the excitation of gas microlasers or the dissociation of toxic or environmentally hazardous gases and vapors.

The prototype multi-stage, ceramic microdischarge device of the FIG. 1A structure produces stable, continuous glow discharges in the rare gases at pressures beyond one atmosphere. Having an active length of ~267 $\mu$m and operating at voltages as low as 137 V, this exemplary prototype five layer, three-section device is monolithic and the materials and fabrication technology employed is well-suited for producing active lengths of at least several mm. Also, the performance of the prototype suggests that it will work equally well at elevated temperatures and with attaching (corrosive) gases, such as the halogen precursors required for the rare gas-halide excimer molecules.

All of the sections of the prototype device were fabricated from low temperature co-fired ceramic tape (DuPont 951 AT Green Tape™). Having a nominal thickness of ~114 $\mu$m (4.5 mils) and composed primarily of alumina, the tape also includes glass additives which permit sintering at reduced temperature (850° C.) while still retaining the excellent insulation properties required for packaging applications.

Five sheets of the ceramic tape (with Mylar backing) were cut into ~15 cm (6") squares. The artwork for the anode and cathode of each microcavity was designed on AutoCAD and arrayed so as to lie within an 11.4 cm (4.5") square region at the center of each of the sheets. This precaution allows for printing of the electrodes while maintaining stringent control over the electrode thickness. After the electrodes were screen printed with DuPont 6145 silver thick film paste, the five individual layers were dried at 60° C. for 10 minutes, stacked in the proper order in an alignment fixture and 250 $\mu$m (10 mil) diameter via holes were punched through the layers and filled with DuPont 6141 silver paste to serve as the electrical connection to the appropriate electrodes. Also, 1 mm (40 mils) square electrical I/O connection pads were printed on the top and bottom layers of the multilayer structure to serve as the anode and cathode connections. The structure was then laminated uniaxially at 1000 psi and 85° C. and, to improve the bonding between sections, the layered structure was subjected to a second lamination process in an isostatic laminator at 5000 psi at 85° C. Individual devices were then cut from the larger sheets with a sharp blade after mounting each sheet on a heated platen. At this point, a 150 $\mu$m diameter cylindrical microdischarge cavity was machined mechanically and the device was fired in air at 850° C. for 30 min. It should be pointed out that although the results presented here are those for a five layer (3 stage)

device, stacks of up to 25 layers can be made at present. The limit on layers is a function of the fabrication process, as previously discussed.

The firing process results in significant shrinkage of the structure: the microcavity diameter decreases by only ~10 μm but the exterior dimensions of the device (in both coordinates transverse to the axis of the microcavity) decline by ~13%. Shrinkage along the longitudinal dimension is 17–18%. Thus, the dimensions of the pre-fired and fired devices are $(1.47\ \text{cm})^2$, ~530 μm thick $((0.58'')^2$, 21 mils thick) and $(1.28\ \text{cm})^2$, ~440 μm thick, respectively. The active length of the device, extending from the upper anode to the lower cathode is 267 μm. Prior to the firing process (left), the cavity diameter is 150 μm, whereas after firing the diameter has decreased slightly to 140 μm.

The prototype in 400 Torr of Ne. The operating voltage and current were 154 V and 1.1 mA which corresponds to a specific power loading of the plasma of ~40 kW-cm$^{-3}$. No effort has been made to date to explore higher values of the latter. In the 300–800 nm spectral region, the power emerging from one end of the structure was measured by a calibrated detector to be 20 μW in a solid angle of $4.5\cdot10^{-2}$sr. Not surprisingly, this device is quite rugged and, although detailed lifetime studies have not yet been carried out, microscopic examinations of the device after two hours of continuous operation found no visible signs of deterioration. The discharges are stable, even for the highest pressures studied (800 Torr), and their emission spatially uniform.

Because of the relatively large microcavity channel diameter used in the prototype experiments, strongest fluorescence is clearly observed for Ne pressures in the 200–400 Torr range which corresponds to a pd product (where p and d are the gas pressure and microcavity diameter, respectively) of 3–6 Torr-cm. Transitions are particularly strong at 200 Torr and, owing to electron heating (and vaporization) of the anodes and ion sputtering of the cathodes, the resonance lines of neutral Ag at 328.07 and 338.29 nm $$\left(5p^2P_{\frac{1}{2},\frac{3}{2}} \rightarrow 5s^2S_{\frac{1}{2}}\right)$$

appear. At still lower Ne pressures (100 Torr, for example), Ag I transitions dominate the spectrum in the 320–370 nm region, which is not surprising since the low pressure spectra were acquired with discharge current densities of ~7 A-cm $^2$. The introduction of more Ag vapor results in the $Ne^+$ lines essentially vanishing because of Penning ionization of Ag by the electronically-excited $Ne^+$ species.

The V-I characteristics of the pre- and post-fired prototype ceramic microdischarges of the invention reveal several interesting trends. A pre-fired device exhibits a positive differential resistance for Ne gas pressures in the 200–700 Torr range whereas the opposite is true once the ceramic structure has been fired. Shrinkage of the device and the change in electrode conductivity that occur during firing are responsible for this change. These and other data acquired to date indicate that controlling the electrical properties of the multilayer structure through the processing procedure (firing time and temperature, layer thicknesses, etc.) is feasible. Operating voltages as low as 137 V and currents up to 2 mA have been obtained for fired devices and $p_{Ne}$=700 Torr while pre-fired structures have been operated at voltages down to 150 V (also at 700 Torr of Ne). Also, a sudden rise in the operating voltage of the pre-fired device for the 200 Torr data and currents above 0.8 mA appears to be due to vaporization of Ag. Starting voltages for the pre- and post-fired devices also differ. For Ne pressures above ~500 Torr, the fired devices have starting voltages more than 10 V lower than those for the unfired microdischarge structures. At pressures below ~400 Torr, the reverse is true. The starting voltage for the fired devices rises as high as 220 V for $P_{Ne}$=200 Torr, whereas that for unfired devices rises more slowly with declining pressure to 175 V at a Ne pressure of 200 Torr.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A microdischarge device, comprising:

a plurality of bonded ceramic layers;

at least two electrodes formed on predetermined ones of said plurality of bonded ceramic layers;

a hole penetrating at least some of said plurality of said bonded ceramic layers, said hole defining a discharge cavity to contain gas or vapor that contacts said at least two electrodes;

electrical contacts to said at least two electrodes.

2. The microdischarge device according to claim 1, wherein said at least two electrodes comprise at least two pairs of electrodes and said electrical contacts comprise a contact for each of said at least two pairs of electrodes.

3. The microdischarge device according to claim 2, wherein said two pairs of electrodes are interdigitated.

4. The microdischarge device according to claim 2, wherein one pair of said at least two pairs of electrodes are adjacent each other.

5. The microdischarge device according to claim 2, said bonded ceramic layers have uniform thickness to space electrodes at uniform distances from each other.

6. The microdischarge device according to claim 2, wherein at least one of said bonded ceramic layers has a thickness different than that of remaining bonded ceramic layers.

7. The microdischarge device according to claim 1, wherein said at least two electrodes comprises an odd number of electrodes.

8. The microdischarge device according to claim 7, wherein two consecutive ones of said odd number of electrodes are connected to a common one of said electrical contacts and at least another one of said odd number of electrodes is connected to another one of said contacts.

9. The microdischarge device according to claim 1, wherein said hole comprises a through hole penetrating all of said plurality of bonded ceramic layers.

10. The microdischarge device according to claim 1, wherein said plurality of bonded ceramic layers are formed on a multilayer ceramic integrated substrate.

11. The microdischarge device according to claim 1, comprising five bonded ceramic layers with four interdigitated electrodes held therebetween and wherein said contacts are exposed on opposite outer surfaces of outer ones of said five bonded ceramic layers.

12. The microdischarge device according to claim 1, wherein said contacts are formed on a common outer surface of an outer one of said bonded ceramic layers.

13. The microdischarge device according to claim 1, wherein said contacts are formed on opposite outer surfaces of outer ones of said bonded ceramic layers.

14. The microdischarge device according to claim 1, formed in an MCIC structure including at least one additional MCIC device.

15. The microdischarge device according to claim 14, wherein said at least one additional MCIC device comprises a MCIC capacitor.

16. A microdischarge device, comprising:

a plurality of bonded ceramic layers;

a first electrode formed on an outer surface of an outer one of said plurality of bonded ceramic layers;

a second electrode formed between said outer one of said plurality of bonded ceramic layers and another one of said plurality of bonded ceramic layers;

a hole penetrating said first electrode and at least said outer one of said plurality of bonded ceramic layers to define a cavity to contain gas or vapor contacting both said first and said second electrodes;

a contact to said second electrode.

17. The mirodischarge device according to claim 16, wherein said contact to second electrode is formed on an opposite outer surface of a lowermost one of said bonded ceramic layers.

* * * * *